US005358245A

United States Patent [19]

Adell

[11] Patent Number: 5,358,245

[45] Date of Patent: Oct. 25, 1994

[54] LOTTERY NUMBER PICKER

[76] Inventor: Robert Adell, 31800 S. Brandingham, Franklin, Mich. 48025

[21] Appl. No.: 86,308

[22] Filed: Jul. 6, 1993

[51] Int. Cl.[5] ..... A63F 3/06; A63F 9/00

[52] U.S. Cl. ..... 273/144 B; 273/148 R

[58] Field of Search ..... 273/144 B, 144 R, 148 R, 273/138 R, 113, 115

[56] References Cited

U.S. PATENT DOCUMENTS 4,807,881 2/1989 Jaquez ..... 273/144 B

FOREIGN PATENT DOCUMENTS 2553153 7/1976 Fed. Rep. of Germany ... 273/144 B 2455777 1/1981 France ..... 273/144 B

*Primary Examiner*—Benjamin H. Layno

*Attorney, Agent, or Firm*—Alex Rhodes

[57] ABSTRACT

A number picker for randomly picking lottery numbers comprising: a base having a pair of cavities, an open ended trap in each cavity for capturing thin cylindrical disks; a plurality of thin cylindrical disks inside of each cavity for capturing some of the disks; and a pair of transparent covers for viewing the disks inside the cavities. Each trap has an outer wall and an inner wall spaced apart from the outer wall and an end portion of its inner wall is hook-shaped and extends outwardly toward its outer wall to resist disks from leaving the trap. The outer walls of the traps are joined to the cavities' outer walls by ramps. When the lottery number picker is rotated, disks pile up at the entrances to the traps, move up the ramps and fill the traps.

22 Claims, 7 Drawing Sheets

UNITED STATES LOTTERIES

| State/U.S. Possession | Daily | Weekly/ Semi-Weekly |
|---|---|---|
| Arizona | | X |
| California | X | X |
| Colorado | | X |
| Connecticut | X | X |
| Washington, D.C. | X | X |
| Delaware | X | X |
| Florida | X | X |
| *Georgia | | |
| Idaho | | X |
| Illinois | X | X |
| Indiana | X | X |
| Iowa | | X |
| Kansas | X | X |
| Kentucky | X | X |
| Louisiana | X | X |
| Maine | X | X |
| Maryland | X | X |
| Massachusetts | X | X |
| Michigan | X | X |

| State/U.S. Possession | Daily | Weekly/ Semi-Weekly |
|---|---|---|
| Minnesota | X | X |
| Missouri | | X |
| Montana | | X |
| *Nebraska | | |
| New Hampshire | X | X |
| New Jersey | X | X |
| New York | X | X |
| Northern Mariana Isles | | |
| Ohio | X | X |
| Oregon | X | X |
| Pennsylvania | X | X |
| South Dakota | | X |
| Texas | | X |
| Vermont | | X |
| **Virgin Islands | | |
| Virginia | X | X |
| Washington | | X |
| West Virginia | X | X |
| Wisconsin | X | X |

*Lottery will become operational in 1993

**Instant Lottery Only

*FIG. 36*

LOTTERY NUMBER PICKER

FIELD OF THE INVENTION

This invention relates to devices for randomly generating numbers and more particularly to a random number generator which is adaptable to the large variations in government lotteries.

BACKGROUND OF THE INVENTION

Government lotteries are one of the world's major businesses. Billions of dollars in revenues are generated by lotteries in the states and U.S. protectorates.

During 1991, the states collected over 21 billion dollars in revenue from state lotteries. This equalled the combined income of America's five most profitable corporations. State lotteries have gained such popular acceptance that it is believed that the federal government may soon adopt a national lottery as a means for trimming its large budget deficits.

Large prizes, some of which exceed one million dollars, attract large numbers of players. Lottery prizes provide a means for ordinary citizens to acquire fortunes which prior to lotteries were inaccessible.

To date, over thirty states, two U.S. protectorates and some foreign countries operate lotteries. Lotteries exist in over thirty states, the U.S. Northern Mariana Islands, U.S. Virgin Islands, Canada, Sweden, France, Australia, Austria, Switzerland and Canada. The distribution of U.S. lotteries is shown in FIG. 36.

A large variation exists in the lotteries of states and foreign countries. By way of example, some weekly lotteries require a selection of five numbers whereas other weekly lotteries require a selection of six numbers. Moreover, there is a large variation in the size of the sets from which numbers are selected ranging from twenty-five to fifty-four numbers in weekly lotteries. Further, daily lotteries require selecting three or four numbers from the set of numbers ranging from 1 to 1000.

Although selecting lottery numbers is a simple task, many players prefer number generating devices, particularly when placing bets on many numbers.

One aspect of the current practice is that lottery number pickers are not adaptable to the large variations in daily and weekly lotteries. Another aspect of the current practice is that lottery number pickers are not available which can pick both daily and weekly lottery numbers. Another aspect of the current practice is that lottery number pickers are complex and expensive to manufacture.

SUMMARY OF THE INVENTION

The present invention satisfies the need for an improved lottery number picker by providing an economical, easy to use device for randomly generating lottery numbers. One feature of the present invention is that the lottery number picker can select both daily and weekly lottery numbers. Another feature of the invention is that the number picker can be easily modified to accommodate different lotteries.

The lottery number picker, in accordance with the present invention, broadly includes a compact housing having an opaque center portion and at least one transparent see-through outer portion. In the housing there is at least one cavity, a plurality of numbered disks stored in said cavity and at least one open ended trap for capturing some of the disks.

The trap is adjacent to the outer wall of the cylindrical cavity and is configured to capture a set of the numbered disks during a rotation of the housing and to impede the flow of captured disks out of the trap.

Lottery numbers are generated by shaking the lottery number selector to randomize the disks and afterwards rotating the number picker to fill the trap with some of the numbered disks.

In a first embodiment of the invention, the housing has a pair of cylindrical cavities in an opaque base for storing thin cylindrical numbered disks, a plurality of numbered disks in each of the cavities for selecting daily and/or weekly lottery numbers and a pair of transparent see-through covers for viewing the disks in each of the cavities.

In another embodiment of the invention, numbered disks are provided in only one of the cavities and an opaque label is applied to one of the transparent covers to cover the cavity not having disks.

Further benefits, features and embodiments of the invention will be apparent from the ensuing description and accompanying drawings which describe the invention in detail. A preferred embodiment is disclosed in accordance with the best mode which is contemplated for practicing the invention and the specific features in which exclusive property rights are claimed are set forth in each of the numbered claims which are appended to the detailed description.

BRIEF DESCRIPTION OF THE DRAWINGS

FIG. 36 is a chart showing the lotteries in various states and possessions of the United States.

DETAILED DESCRIPTION OF THE PREFERRED EMBODIMENT

Figure 3:
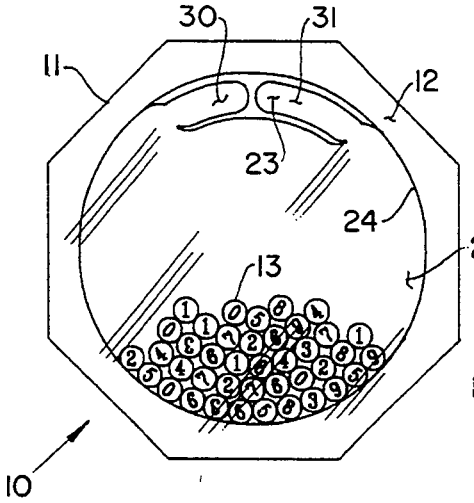
FIG. 3 is a rear view of the lottery number picker.
Figure 2:
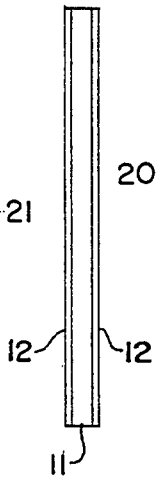
FIG. 2 is a right side view of the lottery number picker.
Figure 1:
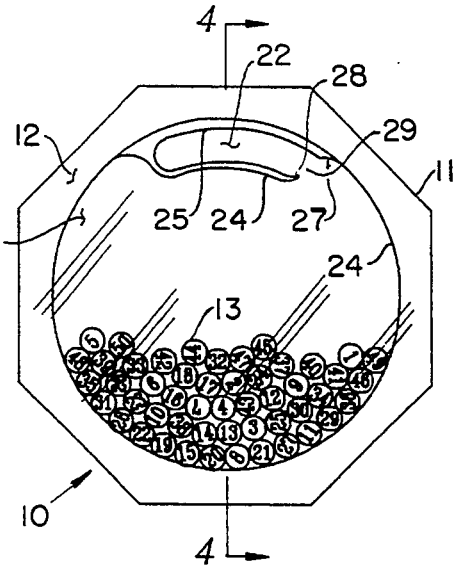
FIG. 1 is a front view of a lottery number picker according to the present invention.

Referring now to the drawings wherein like numerals designate like and corresponding parts throughout the several views, a lottery number picker is shown in FIGS. 1–17, inclusive, in accordance with the present invention. The lottery number picker is designated by the numeral 10 and broadly includes an opaque base 11, a pair of identical see-through transparent covers 12 attached to the base 11, and a plurality of thin cylindrical disks 13 stored in the base 11.

Although the lottery number picker 10 has an octagonal overall shape, it is not my intention to limit my invention to an octagonal shape, since as exemplified by FIGS. 30 through 35, a variety of optional shapes can be applied to my invention, including circular 14, square 15, pentagon 16, hexagon 17, decagon 18 and diamond 19 shapes.

In opposite portions of the base 11 are cylindrical cavities 20, 21 and the thin cylindrical disks 13 in each of the cavities 20, 21. In each cavity 20, 21 there is an open ended trap 22, 23 for capturing the disks 13. With reference to FIGS. 8 through 11, for purposes of describing my invention, a trap 22 is shown for capturing six disks 13 from a set of fifty disks 13 bearing numbers from 1 through 50, it being apparent that the length of the trap 22 can be varied to select lesser or greater numbers of disks 13.

The open ended trap 22 which is an integral portion of the base 11 is adjacent to the cavity's cylindrical wall 24 and is comprised of an arcuate outer wall 25, spaced a short distance inwardly from the cavity's wall 24, and an arcuate inner wall 26 spaced inwardly from the trap's outer wall 25. One feature of my invention is that the disks 13 can easily enter the trap 22 but are impeded from flowing out of the trap 22. As will be understood, this feature results from a ramp 27 which joins the trap's outer wall 25 with the cavity wall 24 and a hooked-end portion 28 of the trap's inner wall 26.

Figure 12:
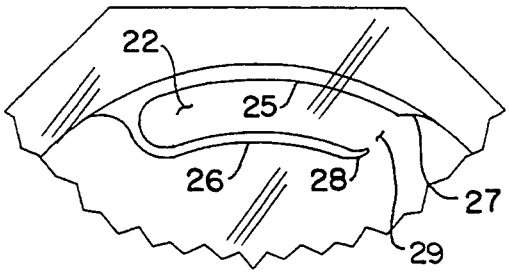
FIG. 12 is an enlarged partial front view of the lottery number picker.

Referring to FIG. 12, at the open end of the trap 22, the trap's outer wall 25 extends a short distance beyond the trap's inner wall 26 and is joined to the cavity's wall 24 by the ramp 27. The end of the trap's inner wall 26 forms the hook-shaped end portion 28 and extends a short distance towards the trap's outer wall 25.

The effect of this construction is best understood by reference to FIGS. 8 through 11. To select a lottery number, the picker 10 is first rotated in a vertical plane about 45 degrees to empty the trap 22 of disks 13. The picker 10 is then agitated to randomize the positions of the disks 13 and then rotated in a vertical plane by a greater amount to capture six disks 13 in the trap 22.

During a filling of the trap 22, disks 13 accumulate at the entrance 29 of the trap 22, impeding a flow of disks 13 out of the trap 22. However, the disks 13 at the entrance 29 to the trap 22 are pushed up the ramp 27 by the inertia forces of the other disks 13. The movement of the disks 13 up the ramp 27 raises the overlying disks 13 which close off the trap 22, thereby allowing disks 13 on the ramp 27 to enter the trap 22.

After the trap 22 has been filled, other disks 13 are prevented from moving up the ramp 27. Further rotation of the picker 10 causes the other disks 13 at the entrance 29 to fall away from the trap 22. At the near horizontal position shown in FIG. 11, the disks 13 inside of the trap 22 are against the inner wall, whereby the hooked-end portion 28 of the inner wall 26 serves to retain the disks 13 in the trap 22.

Figure 17:
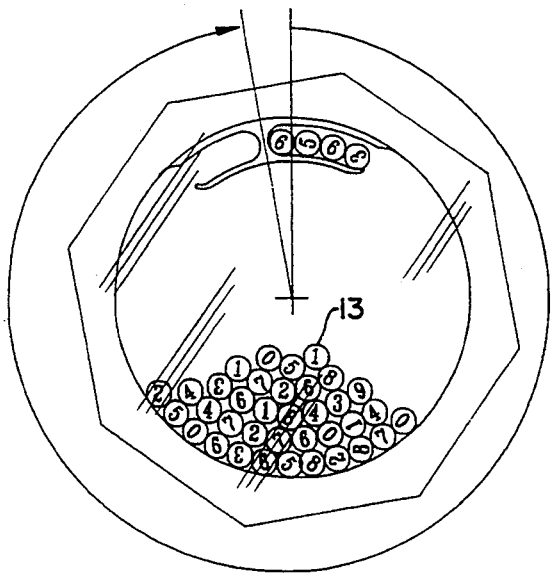
FIG. 17 is a rear view of the lottery number picker in a 350 degree clockwise rotated position.
Figure 14:
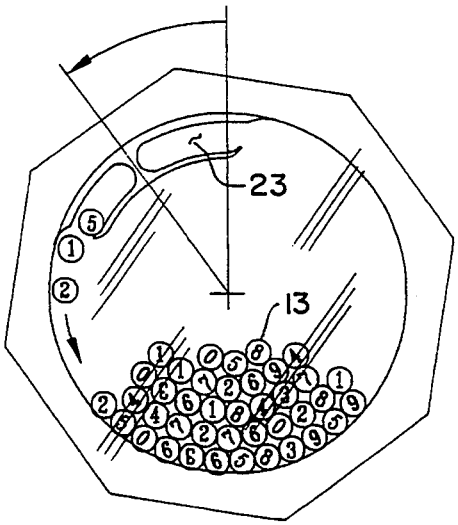
FIG. 14 is a rear view of the lottery number picker in a 35 degree counterclockwise rotated position.
Figure 16:
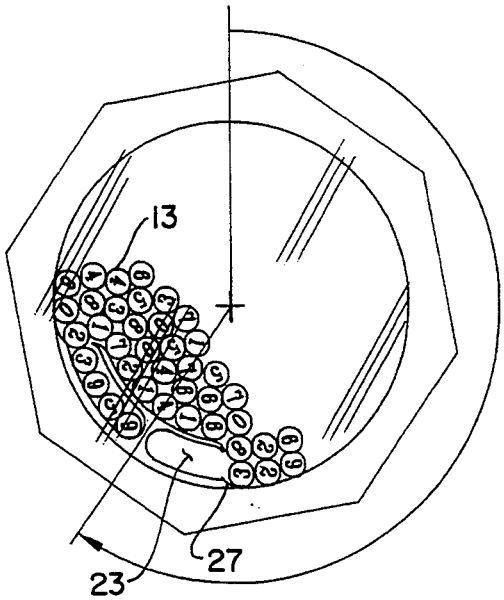
FIG. 16 is a rear view of the lottery number picker in a 225 degree clockwise rotated position.
Figure 15:
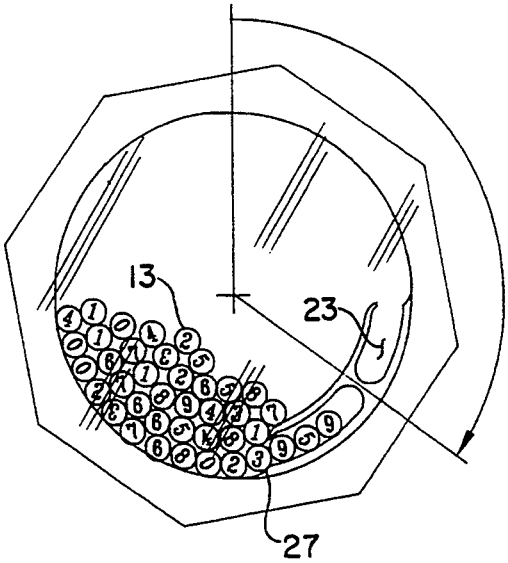
FIG. 15 is a rear view of the lottery number picker in a 135 degree clockwise rotated position.
Figure 20:
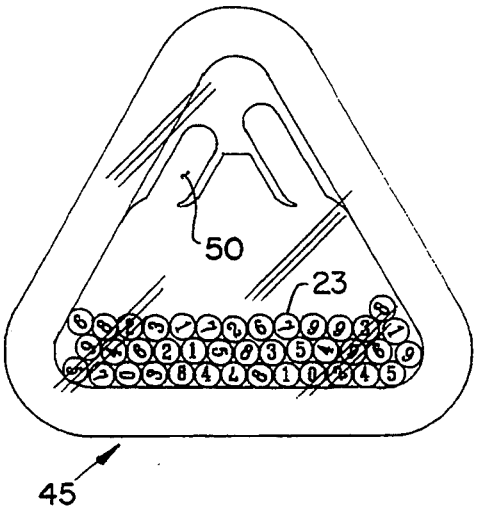
FIG. 20 is a rear view of the alternate embodiment of FIG. 18.
Figure 19:
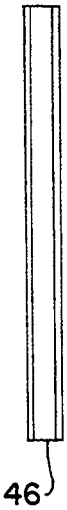
FIG. 19 is a right side view of the alternate embodiment of FIG. 18.
Figure 18:
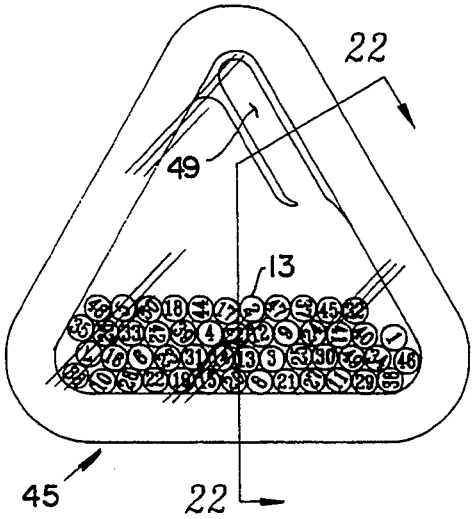
FIG. 18 is a front view of an alternate embodiment.

The random selection of a four-digit number 6563 is depicted in FIGS. 14 through 17. The picker 10 is shown first rotated counterclockwise as depicted in FIG. 14, to empty disks #2, #1, #5 from the portion 30 of the trap 23 used for selecting three-digit numbers. Next, the picker 10 is rotated in a clockwise position as shown in FIGS. 15 through 17 to capture disks #6, #5, #6, #3 in the other portion 31 of the trap 23. During the clockwise rotation, disks 13 are captured in the same manner previously described for capturing six of the disks 13 in the trap 22 of the other cavity 20.

Figure 7:
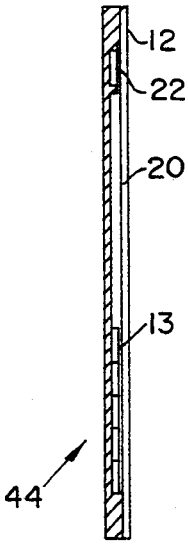
FIG. 7 is an enlarged cross-sectional view of another alternate embodiment taken in a similar manner as FIG. 4.
Figure 6:
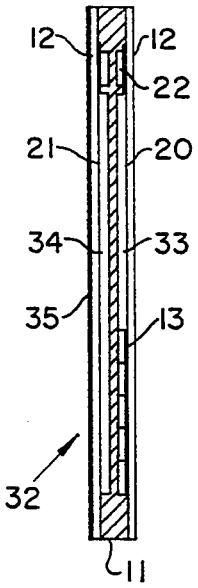
FIG. 6 is an enlarged cross-sectional view of another alternate embodiment taken in a similar manner as FIG. 4.
Figure 5:
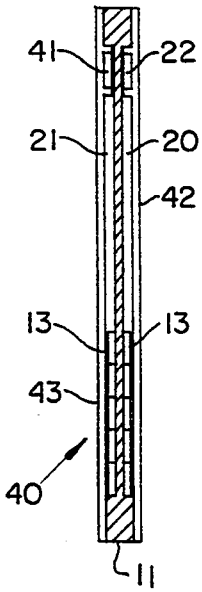
FIG. 5 is an enlarged cross-sectional view of an alternate embodiment taken in a similar manner as FIG. 4.
Figure 4:
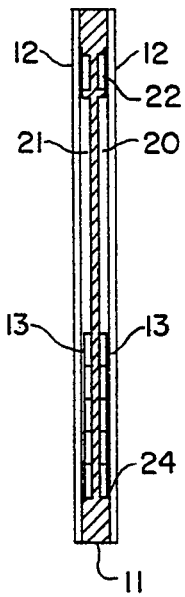
FIG. 4 is an enlarged cross-sectional view taken on the line 4—4 in FIG. 1.
Figure 11:
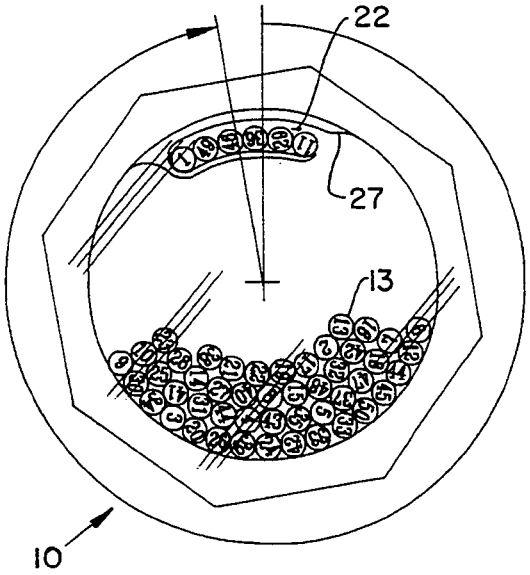
FIG. 11 is a front view of the lottery number picker in a 350 degree clockwise rotated position.
Figure 8:
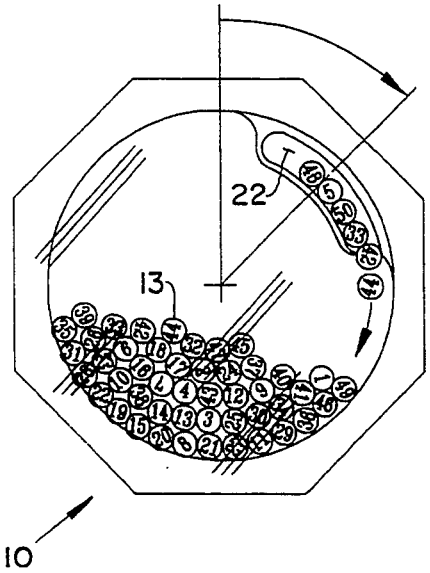
FIG. 8 is a front view of the lottery number picker in a 45 degree clockwise rotated position.
Figure 10:
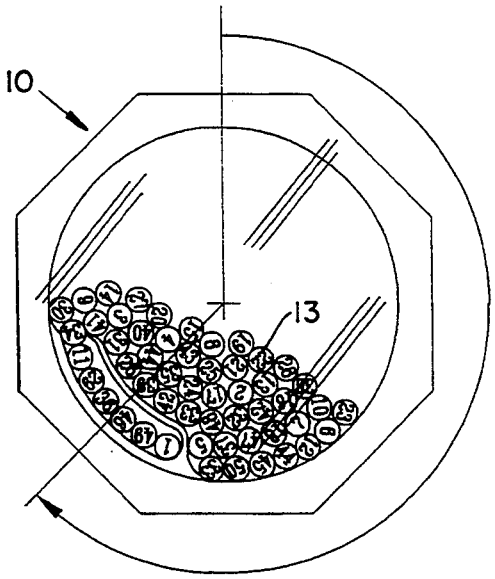
FIG. 10 is a front view of the lottery number picker in a 225 degree clockwise rotated position.
Figure 9:
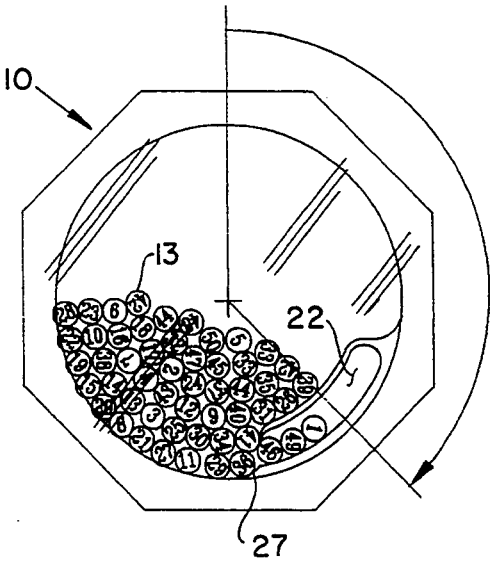
FIG. 9 is a front view of the lottery number picker in a 135 degree clockwise rotated position.
Figure 13:
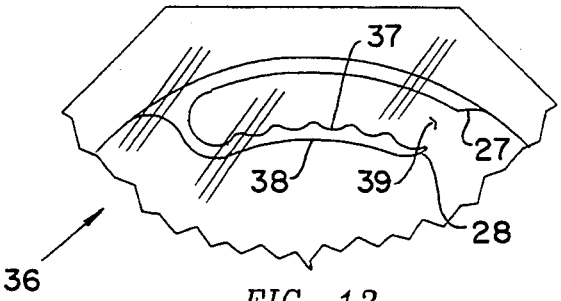
FIG. 13 is an enlarged partial front view of an alternate embodiment.

In FIG. 6, an embodiment 32 is shown wherein the base 11 and covers 12 are used for either daily or weekly lottery pickers. In this embodiment 32, one cavity 33 is loaded with disks 13 and the empty cavity 34 is covered by a label 35 which is attached to the cover 12. In FIG. 13 an embodiment 36 is shown wherein concave depressions 37 are provided in the inner wall 38 of a trap 39 for further resisting the flow of disks 13 out of the trap 39. In FIG. 5 an embodiment 39 is shown wherein the traps 41 are formed as integral portions of upper 42 and lower 43 covers. In FIG. 7 an embodiment 44 is shown having a single cavity for picking either daily or weekly lottery numbers.

Referring now to FIGS. 18 through 23, a circular embodiment 45 is shown having a base 46 with triangular shaped cavities 47, 48 and straight inner and outer trap walls for storing pluralities of thin cylindrical disks 13. The end portions of the inner walls of the traps hook outwardly towards the outer walls and ramps are provided in the same manner as the previously described embodiments. A single trap 49 is provided for capturing six of the disks 13 stored in the cavity 47 and a dual trap 50 in the other cavity 48 is provided for capturing three or four of the disks 13 stored in the cavity 48.

Figure 23:
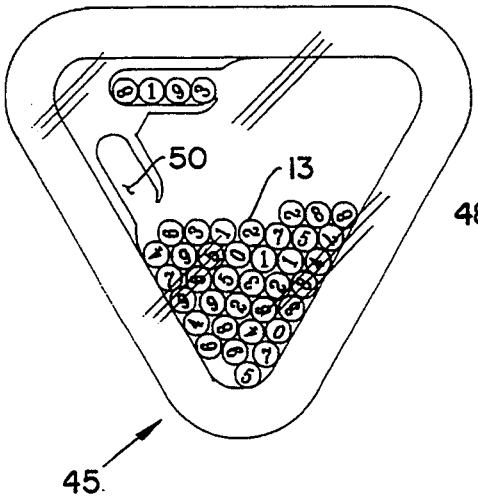
FIG. 23 is a rotated rear view of the alternate embodiment of FIG. 18.
Figure 22:
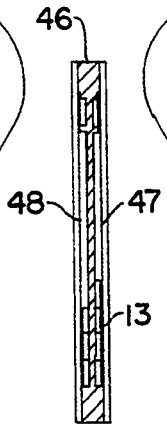
FIG. 22 is a cross-sectional view taken on the line 22—22 in FIG. 18.
Figure 21:
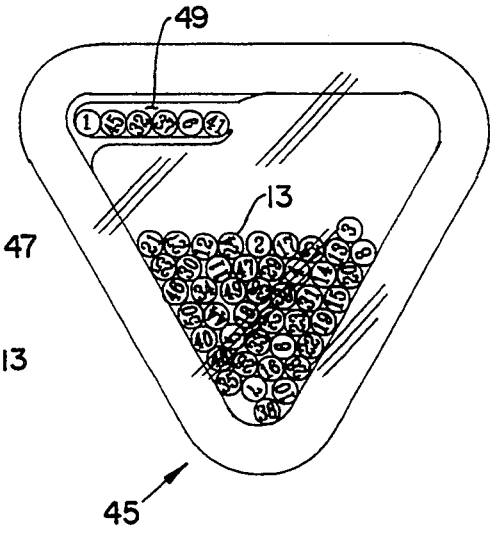
FIG. 21 is a rotated front view of the alternate embodiment of FIG. 18.
Figure 26:
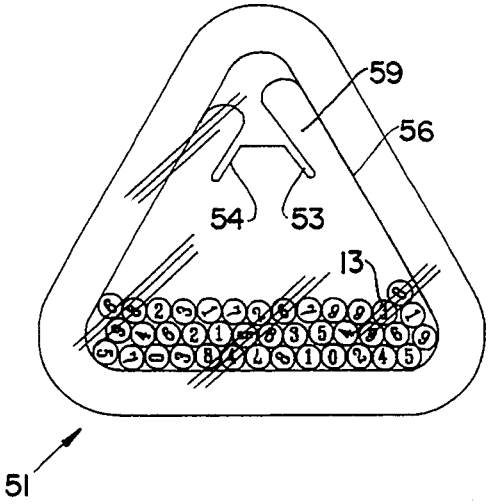
FIG. 26 is a rear view of the alternate embodiment of FIG. 24.
Figure 25:
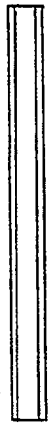
FIG. 25 is a right side view of the alternate embodiment of FIG. 24.
Figure 24:
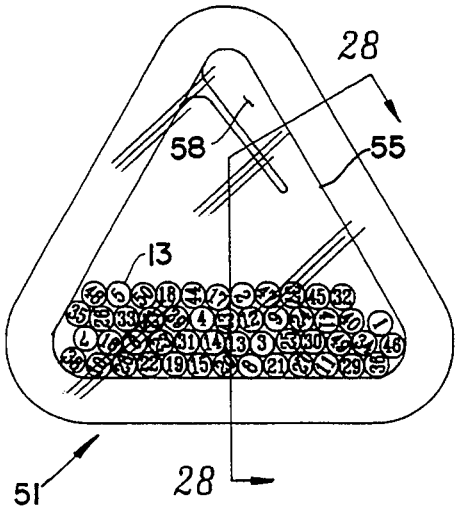
FIG. 24 is a front view of another alternate embodiment.

In FIG. 21 the picker 45 is shown after a clockwise rotation with six of the disks 13 captured in the single trap 49 and in FIG. 23 the picker 45 is shown after a clockwise rotation with four disks 13 captured in the dual trap 50.

In FIGS. 24 through 29 is shown an embodiment 51 which is similar to the embodiment 45 of FIGS. 18 through 23 except that the inner walls 52, 53, 54 of the traps converge towards the outer walls 55, 56, 57 for resisting a flow of disks 13 out of the traps 58, 59.

Figure 29:
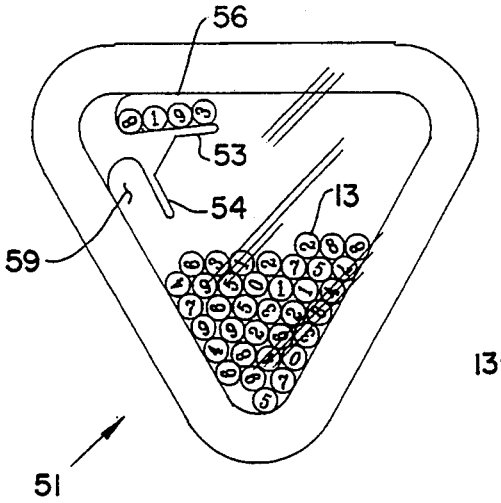
FIG. 29 is a rotated rear view of the alternate embodiment of FIG. 24.
Figure 28:
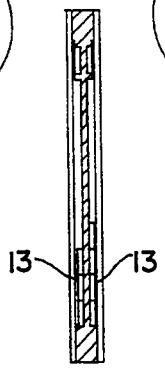
FIG. 28 is a cross-sectional view taken on the line 28—28 in FIG. 24.
Figure 27:
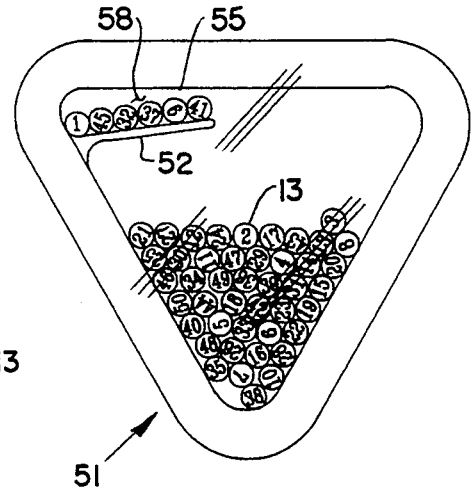
FIG. 27 is a rotated front view of the alternate embodiment of FIG. 24.
Figure 31:
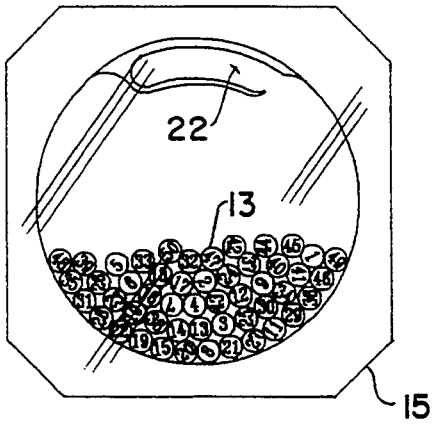
FIG. 31 is a front view of an alternate embodiment having a square outer shape.
Figure 30:
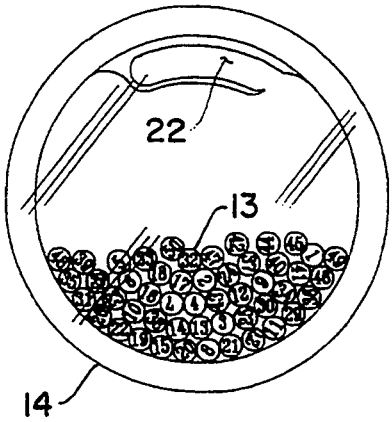
FIG. 30 is a front view of an alternate embodiment having a circular outer shape.
Figure 33:
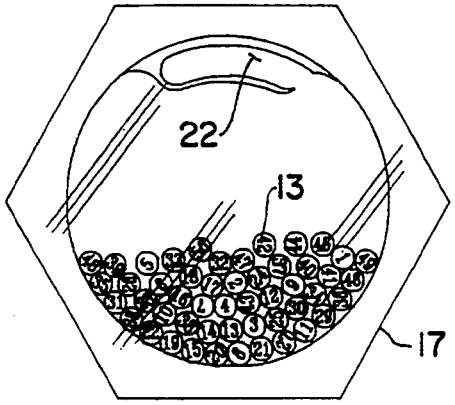
FIG. 33 is a front view of an alternate embodiment having a hexagon outer shape.
Figure 32:
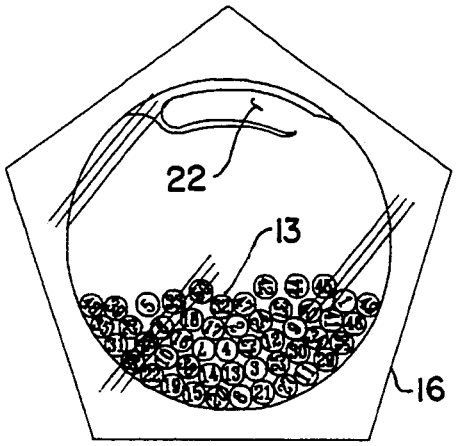
FIG. 32 is a front view of an alternate embodiment having a pentagon outer shape.
Figure 35:
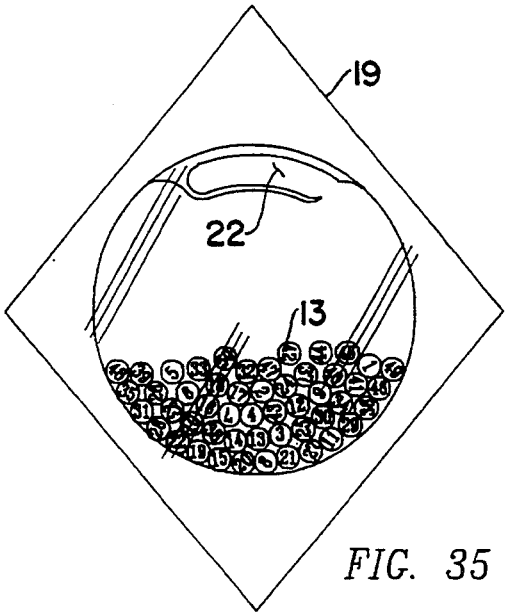
FIG. 35 is a front view of an alternate embodiment having a diamond outer shape.
Figure 34:
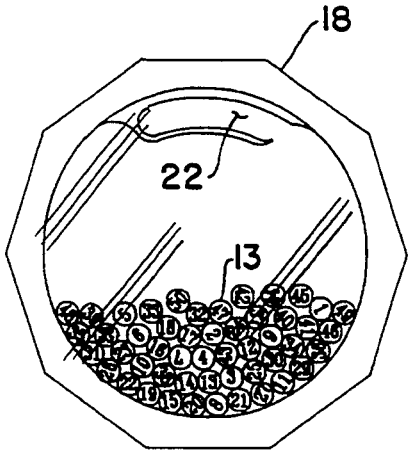
FIG. 34 is a front view of an alternate embodiment having a decagon outer shape.

In FIG. 27 the picker 51 is shown after a clockwise rotation with six of the disks 13 captured in the single trap 58 and in FIG. 29 the picker 45 is shown after a clockwise rotation with four disks 13 captured in the dual trap 59.

From the foregoing it will be appreciated that my invention provides benefits heretofore unavailable in a lottery number picker.

Although but several embodiments have been illustrated and described, it will be understood that other embodiments can be derived by changes in shape and materials as well as numbers and substitutions of parts without departing from the spirit thereof.

I claim:

1. A number picker for randomly picking lottery numbers comprising: a base, said base having at least one cavity, said cavity having a cylindrical outer wall and a single annular trap adjacent to said outer wall for capturing thin cylindrical disks stored in said cavity, said trap having an outer wall spaced inwardly a short distance from said cavity's outer wall, an inner wall spaced inwardly from said trap's outer wall, said inner wall having a hook-end portion for resisting a flow of captured disks out of said trap, and a ramp at said trap's open end, said ramp joining said trap's outer wall to said cavity's outer wall; a plurality of thin cylindrical disks stored in said cavity, each of said disks having a number on a circular face of said disk; and a transparent cover attached to said base for viewing said disks in said cavity.

2. The number picker recited in claim 1 wherein said trap's outer wall is longer than said trap's inner wall, said outer wall having an end portion extending a short distance beyond an end portion of said trap's inner wall at an entrance to said trap.

3. The number picker recited in claim 1 wherein said base is opaque.

4. The number picker recited in claim 1 wherein said trap for capturing disks is an arcuate trap in an outer portion of housing, said trap having an outer wall and an inner wall, said inner wall having a plurality of concave depressions facing said outer wall for resisting a flow of disks out of said trap.

5. The number picker recited in claim 1 further comprising a second trap for capturing a second set of numbered disks.

6. The number picker recited in claim 1 further comprising a second cavity, a transparent cover for viewing a plurality of disks in said second cavity; a trap in said cavity for capturing a second set of numbered disks; and a plurality of thin cylindrical disks inside of said second cavity, each of said disks having a number on a circular face of each of said disks.

7. The number picker recited in claim 1 further comprising a number on an opposite circular face of each of said disks.

8. The number picker recited in claim 1 wherein said trap for capturing disks is a means for capturing three of said disks.

9. The number picker recited in claim 1 wherein said trap for capturing disks is a trap for capturing four of said disks.

10. The number picker recited in claim 1 wherein said trap for capturing disks is a trap for capturing five of said disks.

11. The number picker recited in claim 1 wherein said trap for capturing disks is a trap for capturing six of said disks.

12. The number picker recited in claim 1 wherein said trap for capturing disks is a trap for capturing three or four of said disks.

13. The number picker recited in claim 1 wherein said trap for capturing disks is a trap for capturing three, four or six of said disks.

14. The number picker recited in claim 1 wherein a portion of said base having said cavity is an opaque portion.

15. The number picker recited in claim 1 wherein said base has a circular shaped outer portion.

16. The number picker recited in claim 1 wherein said base has a square shaped outer portion.

17. The number picker recited in claim 1 wherein said base has a pentagon shaped outer portion.

18. The number picker recited in claim 1 wherein said base has a hexagon shaped outer portion.

19. The number picker recited in claim 1 wherein said base has an octagon shaped outer portion.

20. The number picker recited in claim 1 wherein said base has a decagon shaped outer portion.

21. The number picker recited in claim 1 wherein said base has a diamond shaped outer portion.

22. A number picker for selecting lottery numbers comprising: a base, said base having a trap for capturing lottery numbered disks stored in said base, said trap having an outer wall and an inner wall spaced inwardly apart from said outer wall, said inner wall having a hook-shaped end portion at an entrance of said trap extending a short distance outwardly toward said trap's outer wall for impeding thin cylindrical disks in said trap from flowing out of said trap; a ramp at said entrance of said trap for admitting said disks into said trap; and a plurality of thin cylindrical disks stored in said base.

* * * * *